US007950330B2

(12) United States Patent
Smith

(10) Patent No.: US 7,950,330 B2
(45) Date of Patent: May 31, 2011

(54) TUNGSTEN-IRON PROJECTILE

(75) Inventor: Timothy G. Smith, St. Marys, PA (US)

(73) Assignee: Continuous Metal Technology, Inc., Ridgway, PA (US)

( * ) Notice: Subject to any disclaimer, the term of this patent is extended or adjusted under 35 U.S.C. 154(b) by 0 days.

(21) Appl. No.: 12/708,005

(22) Filed: Feb. 18, 2010

(65) Prior Publication Data

US 2010/0212536 A1 Aug. 26, 2010

Related U.S. Application Data

(62) Division of application No. 11/039,102, filed on Jan. 20, 2005, now Pat. No. 7,690,312.

(60) Provisional application No. 60/576,325, filed on Jun. 2, 2004.

(51) Int. Cl.
*F42B 12/74* (2006.01)

(52) U.S. Cl. ..... 102/517

(58) Field of Classification Search ..... 102/516–523; 86/54, 57

See application file for complete search history.

(56) References Cited

U.S. PATENT DOCUMENTS

| | | | | | |
|---|---|---|---|---|---|
| 3,220,103 | A | * | 11/1965 | Simons | 419/66 |
| 3,888,636 | A | * | 6/1975 | Sczerzenie et al. | 75/248 |
| 3,946,673 | A | * | 3/1976 | Hayes | 75/248 |
| 4,379,745 | A | | 4/1983 | Polizzotti et al. | |
| 4,424,083 | A | | 1/1984 | Polizzotti et al. | |
| 5,093,148 | A | | 3/1992 | Christodoulou et al. | |
| 5,189,252 | A | * | 2/1993 | Huffman et al. | 102/459 |
| 5,299,501 | A | * | 4/1994 | Anderson | 102/364 |
| 5,399,187 | A | * | 3/1995 | Mravic et al. | 75/228 |
| 5,527,376 | A | * | 6/1996 | Amick et al. | 75/246 |
| 5,594,186 | A | * | 1/1997 | Krause et al. | 75/228 |
| 5,760,331 | A | * | 6/1998 | Lowden et al. | 102/506 |
| 5,831,188 | A | * | 11/1998 | Amick et al. | 75/246 |
| 5,836,506 | A | | 11/1998 | Hunt et al. | |
| 5,879,817 | A | | 3/1999 | Brown, Jr. et al. | |
| 5,963,776 | A | * | 10/1999 | Lowden et al. | 419/64 |
| 6,073,830 | A | | 6/2000 | Hunt et al. | |
| 6,112,669 | A | * | 9/2000 | Mravic et al. | 102/501 |
| 6,158,351 | A | * | 12/2000 | Mravic et al. | 102/517 |
| 6,479,013 | B1 | | 11/2002 | Sera et al. | |
| 6,536,352 | B1 | * | 3/2003 | Nadkarni et al. | 102/506 |
| 6,589,602 | B2 | | 7/2003 | Kobayashi et al. | |

(Continued)

FOREIGN PATENT DOCUMENTS

EP 626557 A1 * 11/1994

*Primary Examiner* — Troy Chambers
(74) *Attorney, Agent, or Firm* — The Webb Law Firm

(57) ABSTRACT

A projectile includes a compacted and sintered mixture of a plurality of tungsten particles that are from about 8 microns to about 30 microns in size; a plurality of iron particles that are from about 40 microns to about 200 microns in size; and a material additive. At least a portion of the plurality of iron particles are bonded together. There are no intermetallic compounds or alloys of the tungsten particles and the iron particles formed due, in part, to the size of the tungsten particles and the size of the iron particles utilized. The final density of the projectile is from about 8.0 grams per cubic centimeter to about 12.2 grams per cubic centimeter and the final hardness of the projectile is from about 10 HB to about 50 HB. The ratio of the mixture of tungsten particles to iron particles is, by weight, from about 30:70 to about 65:35.

33 Claims, 6 Drawing Sheets

U.S. PATENT DOCUMENTS

| | | | | |
|---|---|---|---|---|
| 6,640,724 | B1 * | 11/2003 | Robinson et al. | 102/517 |
| 6,723,389 | B2 | 4/2004 | Kobayashi et al. | |
| 6,823,798 | B2 * | 11/2004 | Amick | 102/517 |
| 6,884,276 | B2 | 4/2005 | Amick | |
| 6,890,480 | B2 | 5/2005 | Amick | |
| 6,916,354 | B2 * | 7/2005 | Elliott | 75/228 |
| 6,960,319 | B1 * | 11/2005 | Kapoor | 419/11 |
| 7,000,547 | B2 | 2/2006 | Amick | |
| 7,059,233 | B2 * | 6/2006 | Amick | 86/54 |
| 7,073,425 | B1 * | 7/2006 | Allen et al. | 86/57 |
| 7,150,233 | B1 * | 12/2006 | Eberhart | 102/516 |
| 7,267,794 | B2 * | 9/2007 | Amick | 420/94 |
| 2002/0005137 | A1 * | 1/2002 | Stone | 102/517 |
| 2002/0017163 | A1 | 2/2002 | Amick | |
| 2002/0106978 | A1 | 8/2002 | Michaud et al. | |
| 2002/0121317 | A1 | 9/2002 | Amick | |
| 2003/0000341 | A1 | 1/2003 | Amick | |
| 2003/0026966 | A1 | 2/2003 | Kobayashi et al. | |
| 2003/0101891 | A1 * | 6/2003 | Amick | 102/514 |
| 2003/0143099 | A1 | 7/2003 | Amick | |
| 2003/0172775 | A1 | 9/2003 | Amick | |
| 2003/0221580 | A1 * | 12/2003 | Beal | 102/516 |
| 2004/0112243 | A1 * | 6/2004 | Amick | 102/517 |
| 2004/0216589 | A1 | 11/2004 | Amick | |
| 2005/0016411 | A1 | 1/2005 | Amick | |
| 2005/0066850 | A1 | 3/2005 | Leblanc et al. | |
| 2005/0164610 | A1 | 7/2005 | Michaud et al. | |
| 2005/0211125 | A1 * | 9/2005 | Amick | 102/448 |
| 2005/0211126 | A1 | 9/2005 | Hurley | |
| 2006/0051618 | A1 | 3/2006 | Festeau et al. | |
| 2006/0090593 | A1 | 5/2006 | Liu | |
| 2006/0156612 | A1 | 7/2006 | Brzozowski | |
| 2007/0000404 | A1 * | 1/2007 | Eberhart | 102/516 |

* cited by examiner

TUNGSTEN-IRON PROJECTILE

CROSS REFERENCE TO RELATED APPLICATIONS

This application is a divisional application of U.S. application Ser. No. 11/039,102, filed Jan. 20, 2005 and claims priority from U.S. Provisional Patent Application Ser. No. 60/576,325, filed Jun. 2, 2004, which are incorporated herein by reference in their entirety.

BACKGROUND OF THE INVENTION

1. Field of the Invention

The present invention relates generally to the manufacture of projectiles, such as shot, bullets, pellets, and the like, and in particular to a tungsten and iron-based projectile having unique density and softness characteristics, and which can be used in the manufacture of bullets and shot, such as shotgun shot or pellets.

2. Description of Related Art

Presently, projectiles, such as bullets, shot, and pellets, are manufactured from a variety of materials, including many metals, such as lead. However, as the use of lead has decreased, due to well-documented environmental impacts, projectile manufacturers have turned to other metals to replace these lead-based projectiles, such as steel. In particular, various projectiles have been provided, according to the prior art, that are composed of some mixtures of tungsten, nickel, iron, etc. Using these metals, the manufacturer can offer a lead-free and environmentally-safe projectile.

While these prior art lead-free projectiles are useful in many applications, they often have density ranges that are outside the acceptable range for a projectile that effectively emulates a lead bullet or lead shot. Within the small group that yields acceptable density there are no offerings in the current art that are adequately soft and ductile to be used in firearms without special considerations being made. To be more precise, there are no offerings that are adequately soft and ductile to be shotgun-choke responsive. Projectiles made by many of the current manufacturing routes are often much harder than lead and therefore cannot emulate the internal ballistic, external ballistic, and terminal ballistic characteristics of lead-base projectiles and shot.

As one substitute for lead shot pellets, and according to the prior art, steel shot pellets have been developed and are in widespread use. Steel shot falls far short of the density of lead (7.8 g/cc vs. 11.2 g/cc) and therefore has significantly lower performance. Further, these steel shot pellets are significantly harder than lead and therefore are not appropriately deformable and do not typically produce uniform pattern densities, particularly at extended range. Further, special considerations need to be made with regard to the firearm in order for steel shot to be used safely. In order to provide an effective pattern density, shells with variably sized pellets have been produced in order to provide the appropriate pattern density. However, variably sized shot pellets have varying external and terminal ballistics. Accordingly, steel shot pellets are not an effective substitute for lead shot. In all cases with steel shot, performance is significantly limited by the hardness and density of steel.

As is known in the art, in the manufacturing of shot, various powdered metal materials are often compacted and subsequently sintered in order to form the projectile. This prior art can be generally subdivided into several distinct categories.

One category is considered to be frangible, such that the projectiles disintegrate upon impact of the target or backstop and are used mainly for training purposes for law enforcement and military personnel. The disintegration of these projectiles reduces the risk of ricochet and therefore is considered to be a safer choice than other alternatives especially in close range combat simulation. These materials (by design) are brittle and the particles must only be lightly bonded in order to meet the requirements of the application. Some of these materials are relatively porous, however they lack sufficient bonding to impart significant ductility to the resulting projectile. Frangible ammunition utilizing sintering techniques is generally made by one of two methods: (1) low-temperature solid state sintering, in which the temperature remains below the solidus of any of the materials in the mixture; or (2) transient liquid phase sintering, which is a process where bonding occurs as the temperature is elevated above the eutectic of two materials and a temporary liquid is formed. As soon as the liquid forms, it alloys with the other metal and the melting point rises such that there is no longer liquid. The result is light metal-to-metal bonding that relies on the small, weak, and brittle intermetallic compounds that form at the contact points of the particles as a result of passing through the eutectic temperature. Several sintered (non-polymer bonded) variants on these basic methods exist, however, the goal remains the same—brittle bonding to achieve the goal of frangibility.

A second major category of powdered metal approaches to ammunition involves mechanical pressing that serves primarily as a shaping function and sinter-densification to reach the desired density. This second category of approaches utilizes very fine metal particles (some of which may be tungsten and iron) that are sintered at high temperatures (in excess of about 80% of the melting point) or liquid phase sintered in which the sintering temperature is at least above the solidus one of the materials.

In order to densify to near full theoretical density, powders below about 6 microns are generally used. Such methods are commonly employed in the manufacture of tungsten heavy alloy components for a wide range of applications and these methods are well known in the art. This second category of approaches is essentially an adaptation of the technology for production of tungsten heavy alloys for the manufacture of high-density ammunition components and to a large degree employs the same basic techniques and principles, which are well published. Densities greater than lead are possible, with near full theoretical density commonplace, however, these methods produce components with high hardness values that are very similar to or higher than steel.

As is taught by the literature with respect to tungsten heavy alloy production, powdered metals for these approaches are typically very small and spherical or semi-spherical. The small size lowers the necessary sintering temperature and allows near complete densification, however, when powder pressing methods are used, higher levels of polymer are added to compensate for the lack of mechanical interlocking typical for spherical powders. In particular, small semi-spherical powders are not readily compacted in traditional powder metallurgy methods due to a lack of mechanical interlocking during pressing and require relatively large amounts of wax or polymer to adhere the particles. The main reason for this difficulty is that mechanical powder compaction relies largely on deformation and interlocking of large, irregular shaped particles to provide the strength required for ejection from the die. In the case of small semi-spherical powders, the polymer is used as a "binder", whereas with large irregular powders, it is used at a much lower level as a "lubricant" to assist in ejection and does not impart significant strength to the compacted part.

Typical sintering temperatures for alloys containing tungsten and iron are above 1450° C. and require the use of special high-temperature furnaces. Lower temperatures can be used, however, sintered density is greatly reduced, thus becoming self-defeating. Further, such high-temperature or liquid phase sintering of tungsten alloys requires the use of high levels of hydrogen in the sintering atmosphere in order to reduce the surface oxides present on the powder surfaces. Because the surface area for a given mass increases as particle size decreases and surface oxides are always present at some level, there is a larger proportion of metal oxide present with smaller particles. This oxide must be reduced prior to pore closure during sintering or gases that evolve from the reduction of these oxides will create trapped porosity. This phenomenon is well documented in the literature and is sometimes termed "hydrogen embrittlement" due to the fact that oxides trapped in the interstitial spaces between particles can form water molecules in the presence of hydrogen. These trapped water molecules are too large to escape through the matrix or grain boundaries and therefore increase the brittleness of the material due to pores remaining after sintering. Further, due to the high binder content necessitated by the particle shape, surface oxides are not acted upon by mechanical smearing as much as with larger irregular powders due to the lubricating hydraulic boundary layer effect that the excess binder produces.

In systems with a high and low melting point material, such as tungsten and iron containing systems using high temperature or liquid state sintering processes, significant bonding occurs between the high melting point metals due to the enhanced mobility of the atoms of the high melting point metal within the liquid matrix. However, depending upon several factors, such as solubility limit, the amount of higher melting point metal, processing temperatures, etc., a solid solution may result after cooling, which can have a wide range of microstructural characteristics from fine dispersed grains to very large solid interconnected grains. In the case of a two-metal system in which there is no solubility of the higher melting point metal in the matrix, no solid solution will occur, and sintering relies instead on liquid filling in the spaces between the higher melting point particles. In liquid phase sintering, the liquid that is formed greatly increases the surface contact area between particles and dramatically increases mass transport mechanisms. This subsequently leads to rapid rounding of porosity and densification. The use of smaller particles is beneficial in this type of processing due to the inverse relationship between particle size (diameter) and surface energy, as is well described in the literature. As particle size is decreased, the ratio of surface area to volume is increased, thus creating an energy gradient promoting mass transfer between particles (see FIG. 6). This driving force slows as surface area (and consequently surface energy) is reduced until equilibrium conditions are approached and densification essentially ceases.

Another factor that provides drawbacks to prior art projectiles and shot arises from the sintering temperatures and resulting structures of the mixed compound. For example, many of the mixtures of metals are sintered at a temperature where an alloy, intermetallic, metal matrix, etc. are formed. The need for these higher temperatures and highly reducing atmospheres significantly increases the processing costs associated with this sintering method. The formation of these materials and compounds has particular drawbacks to the resulting softness (or hardness) of the projectile. This type of system, where mass transport is great, can result in the widespread formation of intermetallic compounds in tungsten-iron systems, as tungsten atoms are highly mobile in iron at this temperature range. Higher levels of intermetallic compounds lead to decreasing ductility. In addition to the reduced hardness of the present invention, the larger amount of retained porosity allows for the projectile to be easily deformed by a shotgun choke. This, in turn, improves ballistic performance.

SUMMARY OF THE INVENTION

It is, therefore, an object of the present invention to provide a tungsten-iron projectile that overcomes the deficiencies of the prior art, such as high hardness, brittleness, high manufacturing cost, etc. It is another object of the present invention to provide a tungsten-iron projectile that includes and results in a projectile having the appropriate emulation characteristics with respect to lead-based materials and similar functionalities. It is yet another object of the present invention to provide a tungsten-iron projectile where the projectile is significantly softer than currently-produced sintered, powder based, non-frangible projectiles. It is a still further object of the present invention to provide a tungsten-iron projectile which includes and results in a projectile having a variable density in a specific and desired range. It is another object of the present invention to provide a tungsten-iron projectile where the projectile has significantly reduced hardness over currently produced tungsten-iron-containing shot. It is a still further object of the present invention to provide a tungsten-iron projectile that is particularly useful as shot for, for example, shotguns. It is yet another object of the present invention to provide a tungsten-iron projectile where the projectile is not frangible and possesses significant ductility without brittle failure.

Accordingly, the present invention is directed to a projectile. Specifically, the projectile includes a compacted and sintered mixture of tungsten particles and iron particles. At least a portion of the iron particles are bonded together. During the compacting and sintering processes, there are no intermetallic compounds, alloys, or metal matrices formed between the tungsten particles and iron particles. In addition, the final density of the projectile is from about 8.0 grams per cubic centimeter to about 12.2 grams per cubic centimeter. Further, there is no substantial densification occurring during the sintering process.

In one embodiment, the tungsten particles are from about 8 microns to about 30 microns in diameter. The iron particles are from about 40 microns to about 200 microns in size and are non-spherical. In addition, both the tungsten particles and the iron particles may be shaped such that they can be used in a cold compaction powdered metallurgy process.

In another embodiment, the mixture is sintered in a sintering furnace under controlled atmospheric conditions, such as the use of a mildly oxidizing gaseous material, an inert gaseous material, a reducing gaseous material, etc. Further, the projectile is sintered in a solid state sintering process where no applicable densification occurs (i.e., reduction in porosity) and is formed with a final hardness from about 10 HRB to about 80 HRB. The ratio of the mixture of tungsten particles to iron particles is, by weight, from about 30:70 to about 65:35.

In yet another embodiment, the present invention is directed to a projectile that includes a compacted and sintered mixture of: a) a plurality of tungsten particles that are from about 8 microns to about 30 microns in size; b) a plurality of iron particles that are from about 40 microns to about 200 microns in size; and c) a material additive comprising at least one of the following: a chemical compound, a polymeric compound, a binder, and a lubricant. At least a portion of the plurality of iron particles are bonded together. There are no intermetallic compounds or alloys of the tungsten particles and the iron particles formed due, in part, to the size of the tungsten particles and the size of the iron particles utilized. The final density of the projectile is from about 8.0 grams per cubic centimeter to about 12.2 grams per cubic centimeter and the final hardness of the projectile is from about 10 HB to about 50 HB. Densification is achieved when the mixture is compacted due to mechanical bond formation between the plurality of tungsten particles and the plurality of iron particles and there is no substantial densification occurring as a result of sintering. The ratio of the mixture of tungsten particles to iron particles is, by weight, from about 30:70 to about 65:35.

The present invention, both as to its construction and its method of operation, together with the additional objects and advantages thereof, will best be understood from the following description of exemplary embodiments when read in connection with the accompanying drawings.

DESCRIPTION OF THE PREFERRED EMBODIMENTS

Figure 1:
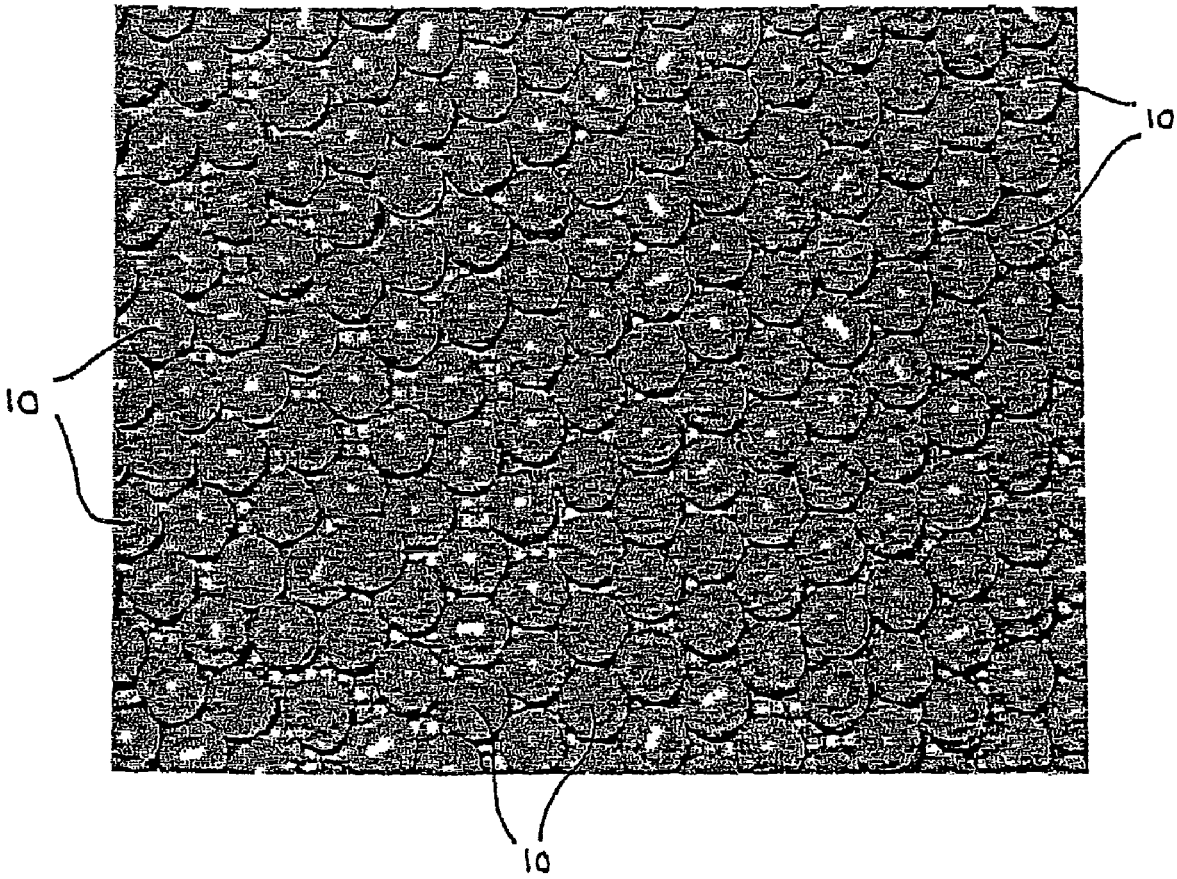
FIG. 1 is a photograph of a compacted and sintered projectile according to the present invention.

Other than in the operating examples or where otherwise indicated, all numbers or expressions referring to quantities of ingredients, reaction conditions, etc., used in the specification and claims are to be understood as modified in all instances by the term "about". Various numerical ranges are disclosed in this patent application. Because these ranges are continuous, they include every value between the minimum and maximum values. Unless expressly indicated otherwise, the various numerical ranges specified in this application are approximations.

For purposes of the following discussion, a single melting point material is a material whose solidus and liquidus is the same temperature. An example of a single melting point material is a pure metallic element. In particular, the melting point of iron is 2800° F. (1538° C.), and the melting point of tungsten is 6191° F. (3422° C.). The solidus of a material is a temperature for which the material first liquifies. In particular, below this temperature, the material is a solid and no liquid is present. Between the solidus and liquidus states, there is a slushy state, which becomes more liquid as it approaches the liquidus. This slushy state is observed in the melting of many alloys. According to the prior art, it is in this temperature range above the solidus that liquid phase sintering occurs. Liquid phase sintering can be further broken down into many sub-groups such as supersolidus sintering and true liquid phase sintering, however, all subcategories of liquid phase sintering occur above the solidus temperature.

The liquidus is the temperature for a material at which there is complete liquid, without any solids present. Above this temperature, melt processing occurs, such as casting. A system may be considered a two-material system with high and low melting constituents, in which the low melting point metal has its own single melting point or solidus-liquidus range, and yet another solidus-liquidus range for a solution of the two metals. Many prior art processes employ melt processing of tungsten-based alloys.

A solid solution is generally considered a material with solid particles that have dissolved in a lower melting point matrix metal. The matrix dissolves the solid particles, which go into solution. Depending upon several factors, such as the amount of each metal, dwell-time at the temperature, oxide level present, processing temperature, cooling rate, etc., the solid particles may remain very small or may precipitate and grow into larger grains. In a powdered metal system containing only tungsten and iron, tungsten atoms have a low probability of becoming mobile until very high temperatures are reached. Mobility is further slowed by increases in particle size due to reduced surface energy.

Liquid phase sintering, as discussed above in detail, is a sintering process that occurs at a temperature above the solidus of one or more of the constituent materials. Solid state sintering is a sintering process that occurs at a temperature below the solidus of any of the constituent materials. Specifically, particles form bonds along the regions that have been forced into close contact during pressing or compacting of these particles. Bonding occurs by atoms moving into the vacancies between particle boundaries, however, the particles are essentially the same size and shape before and after the sintering process. Dimensional changes of the compacted mixture are small. In addition, no liquid metal is present at any stage during the solid state sintering process. To further clarify, tungsten mobility is statistically insignificant, if not absent, in the current invention due to the relatively low processing temperature range.

During the solid state sintering process, neutral or slightly reducing atmospheres may be used, since the oxide layer on the outside of the powdered particles is mechanically smeared during the pressing operation, which prepares the metal in these regions for sinter bonding.

According to the current invention, a projectile 10 is formed through a compaction and sintering process. As illustrated in FIG. 1, the projectile 10 has a modified spherical shape after the compaction and sintering processes have occurred. Further, what is illustrated in FIG. 1 is a compacted and sintered mixture of a plurality of tungsten particles and a plurality of iron particles, which form the basic constituents of the projectile 10. At least portions of the plurality of iron particles are bonded together. Importantly, during the compacting and sintering processes, no intermetallic compounds, alloys, or metal matrices of the tungsten particles and the iron particles are formed. In addition, the final density of the projectile 10 is from about 8.0 grams per cubic centimeter to about 12.2 grams per cubic centimeter and is nearly the same before and after sintering. In addition, during the sintering process, no substantial densification occurs.

The present invention uses tungsten particles and iron particles that are much larger than those used in the prior art. In one embodiment, the tungsten particles are from about 8 microns to about 30 microns in diameter, and the iron particles are from about 40 microns to about 200 microns in size. Various forms of iron particles may be utilized in the current invention. For example, these iron particles may be water-atomized iron particles, sponge iron particles, iron powder, etc. Further, such iron powder is of a type that is typically used for pressed metal compositions. The use of such iron powder allows for a higher pressed density than is exhibited in the prior art, which uses fine, relatively incompressible carbonyl iron powder.

In one preferred and non-limiting embodiment, the tungsten particles and iron particles are formed into the projectile 10 through a compaction process. For example, the tungsten particles and iron particles may be mechanically compacted in a die. Still further, the tungsten particles and the iron particles may be pre-blended prior to this compaction. After compaction, the compacted or pressed density varies according to the composition of tungsten and iron used. In one example, the pressed density is as follows:

| Tungsten:Iron | Density Range (g/cm$^3$) |
|---|---|
| 50:50 | 9.4-10.5 |
| 55:45 | 9.8-11.0 |
| 60:40 | 10.3-11.5 |
| 65:35 | 10.8-12.1 |

Figure 2:
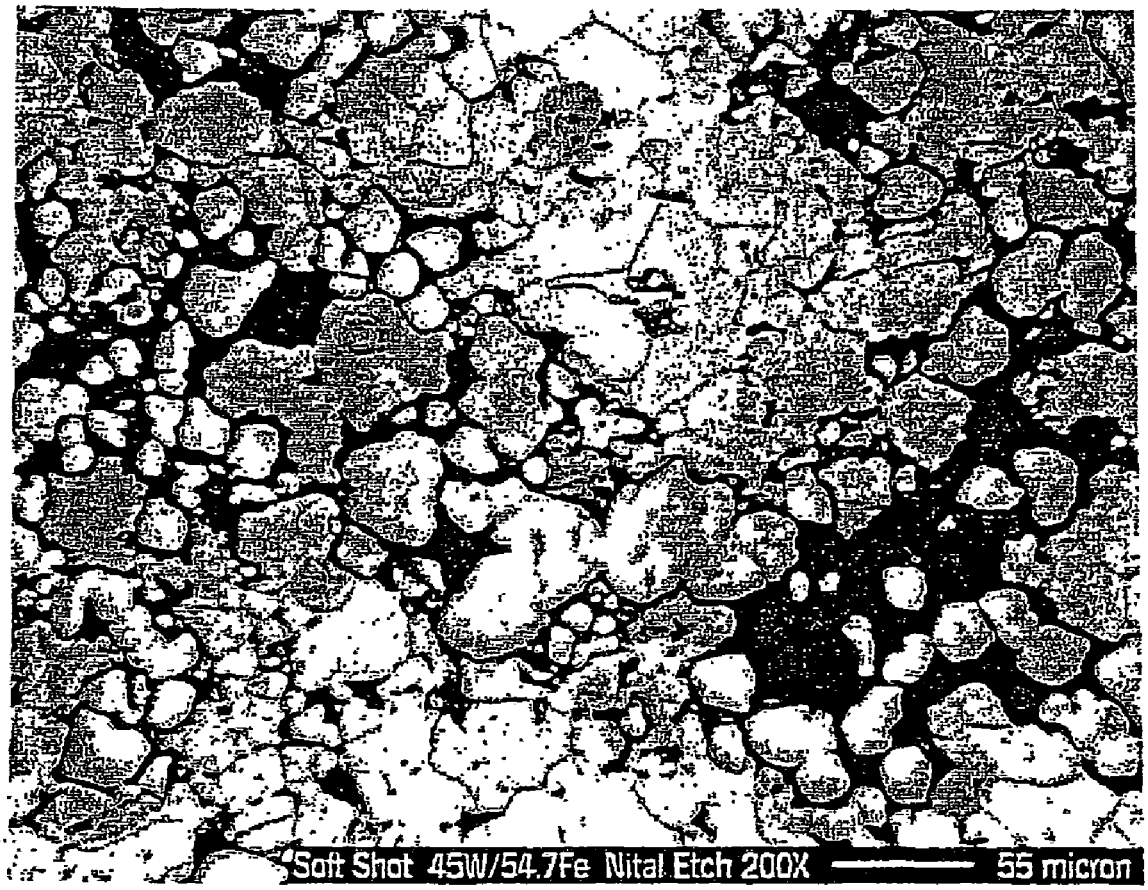
FIG. 2 is a photomicrograph of one embodiment of the projectile according to the present invention magnified at 200 times.
Figure 3:
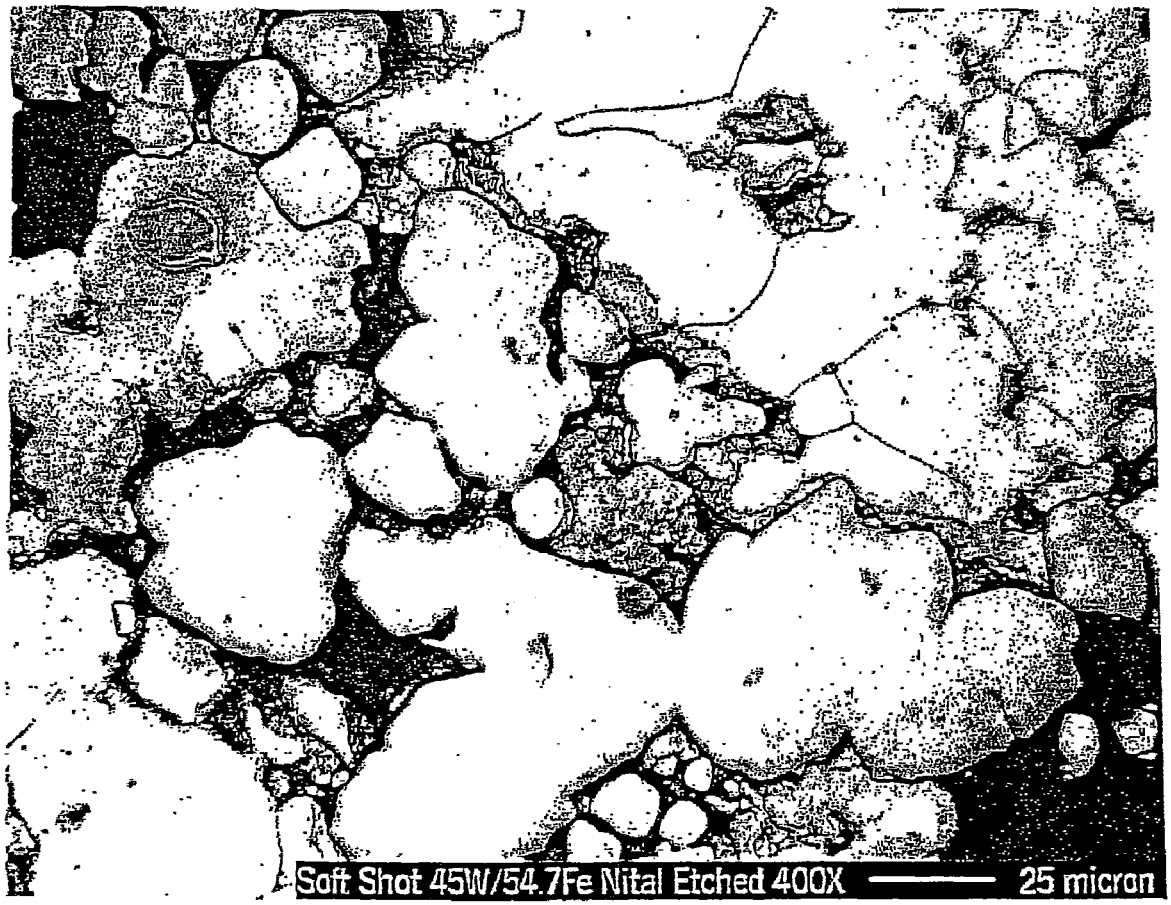
FIG. 3 is a photomicrograph of one embodiment of the projectile according to the present invention magnified at 400 times.

FIGS. 2 and 3 illustrate one embodiment of the microstructure of the projectile 10 after the compaction process. It should be noted that, as evidenced by the further micrograph illustrations, the resulting projectile 10 has a high degree of porosity and no interconnected tungsten particles.

During the forming process, such as in the compaction process, various material additives may be used. For example, the material additive may be a chemical compound, a polymeric compound, a lubricant, a binder, etc. For example, polymeric additives may be used and varied depending upon the forming process, but these material additives may also include certain metals or metal compounds to further effect and enhance the sintering process. In addition, these additives may enhance the physical and/or chemical characteristics and properties of the projectile after sintering. Simple polymer additions for die compaction may be used to reduce die wall friction.

In one embodiment, the chemical additive is a lubricant, and the lubricant is added to a mixture of the tungsten particles and iron particles during the compaction process. In one preferred and non-limiting embodiment, the lubricant comprises up to 1% by weight of the mixture. While the material additive may be any compound suitable to enhance the physical and/or chemical characteristics of the projectile 10 and the manufacturing process, in one embodiment, the material additive may be ethylenebisstearimide, lithium carbonate compound, a stearate compound, a copper stearate, a zinc stearate, etc.

Figure 4:
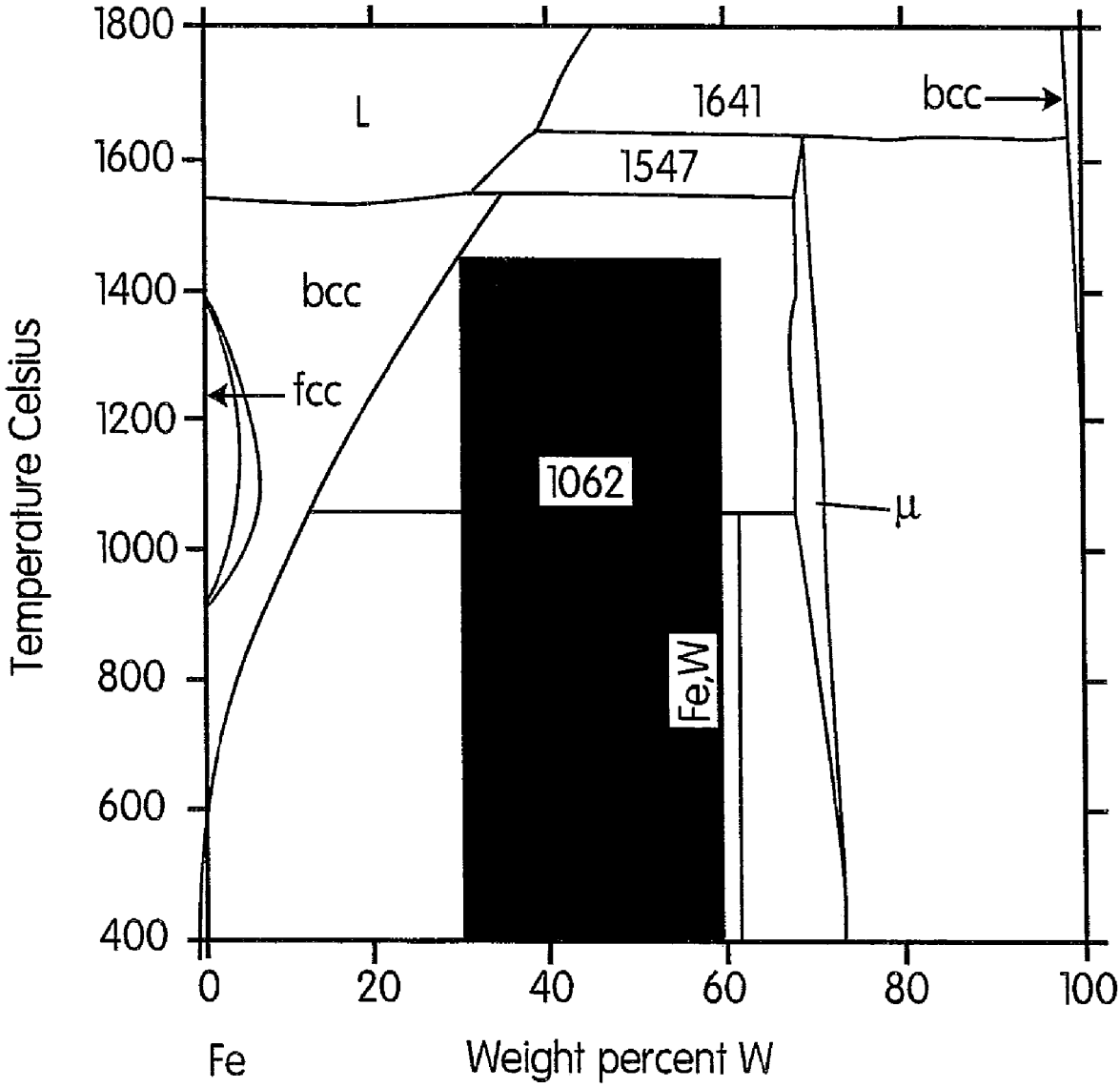
FIG. 4 is an equilibrium phase diagram for tungsten and iron illustrating the operating region of the manufacturing method according to the present invention.

After compaction, the projectile 10 is sintered, such as in a sintering furnace, under controllable atmospheric conditions. The temperature of the sintering process may be from about 1500° F. to about 2450° F. One example of the operating range of the sintering process is illustrated in FIG. 4.

The controllable atmospheric conditions may include the use of a mildly oxidizing gaseous material, an inert gaseous material, a reducing gaseous material, etc. In addition, as discussed above, the projectile 10 is sintered in a solid state sintering process relying on surface diffusion and grain boundary diffusion as the predominate mechanisms for practical bonding, such that no liquid metal or pore annihilation are present at any stage during the process. In addition, no intermetallic materials, alloys, or metal matrices are formed during this solid state sintering process, chiefly due to the sintering temperature discussed above and by the use of particles with a mean size greater than, for example, 6 microns.

After compaction and sintering, the final density of the projectile 10 is from about 8.0 grams per cubic centimeter to about 12.2 grams per cubic centimeter. Again, the final density ranges vary according to the ratio of tungsten to iron used in projectile 10. In one embodiment, the final density for various ratios of tungsten and iron are as follows:

| Tungsten:Iron | Density Range (g/cm$^3$) |
|---|---|
| 50:50 | 9.5-10.6 |
| 55:45 | 9.9-11.1 |
| 60:40 | 10.4-11.6 |
| 65:35 | 10.9-12.2 |

Figure 5:
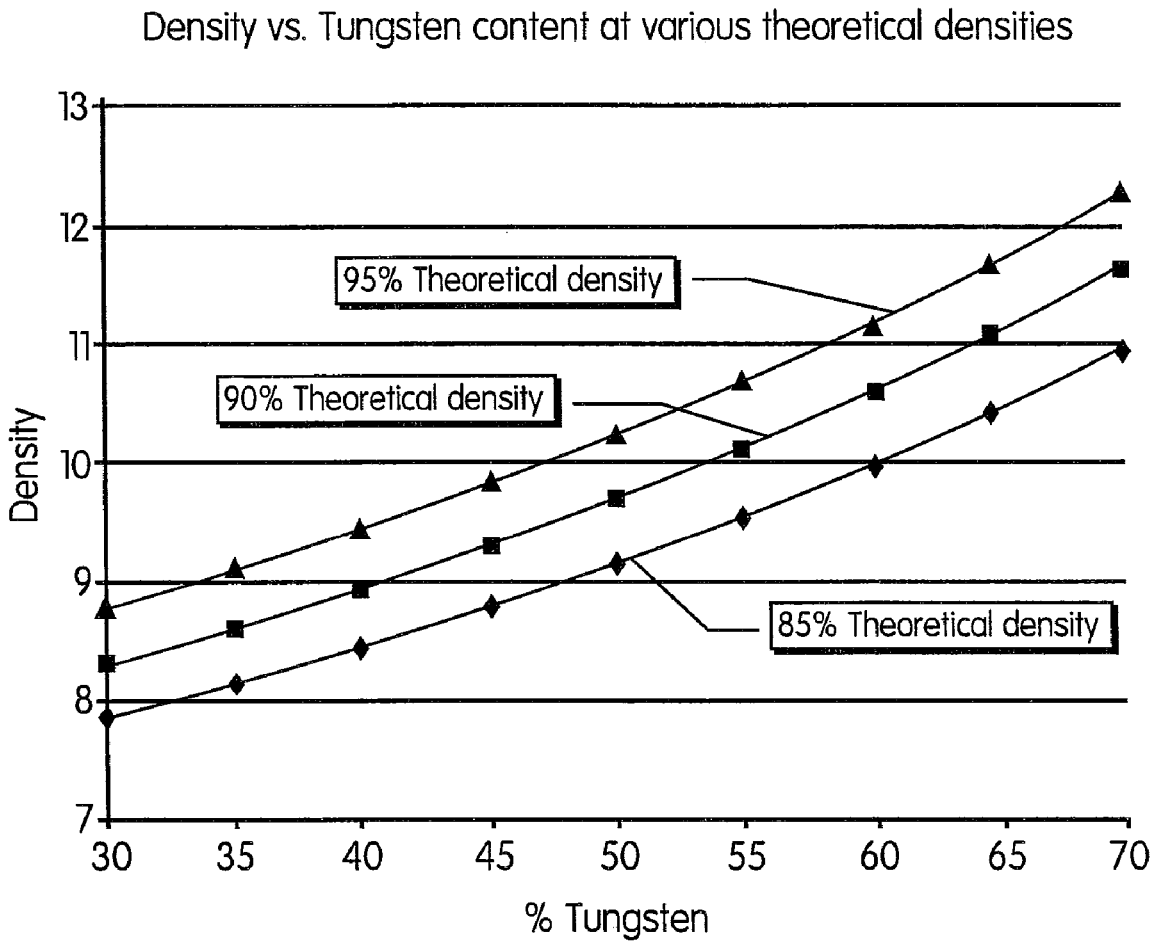
FIG. 5 is a graph plotting density versus tungsten content at various theoretical densities in manufacturing the projectile according to the present invention.
Figure 6:
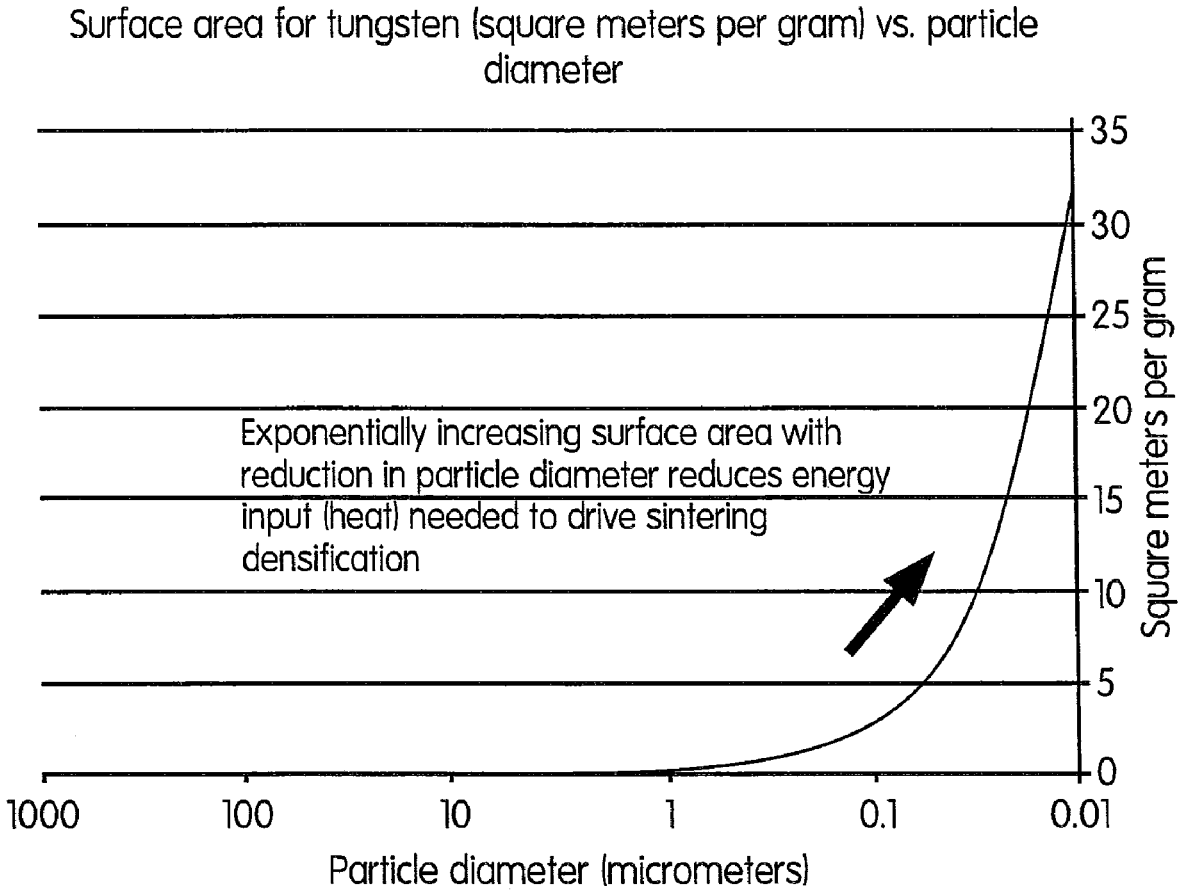
FIG. 6 is a graph plotting surface area of tungsten as a function of particle diameter.

It should be noted that there is no appreciable densification and the density after sintering is essentially the same as it was prior to the sintering process, since the densification of the projectile 10 is achieved during the compaction process, which, as discussed above, uses mechanical bond formation to form the projectile 10. FIG. 5 graphically illustrates the relationship between sintered density, tungsten content, and percent of theoretical density.

The final hardness of the projectile 10 after sintering is in the range of about 10 HRB to about 80 HRB. Also, the ratio of tungsten particles to iron particles is variable, as discussed above. For example, the mixture of tungsten particles to iron particles may be, by weight, from about 30:70 to about 65:35.

The compacted and sintered projectile 10 may be a shot pellet, a bullet, etc. In addition, the final hardness of the formed and sintered projectile 10 is less than the final hardness of steel shot. Still further, the resulting projectiles 10 are essentially non-fragmenting and exhibit a high degree of ductility.

Example 1

In one preferred and non-limiting embodiment of the present invention, the projectile was prepared by blending 45% Titan 24 micron tungsten powder (TW24), 54.7% A-1000-B iron powder (as supplied by ARC Metals), and 0.3% Acrawax. Five hundred pounds of this mixture was blended in a Patterson-Kelly Twin Shell "V" blender for twenty minutes. The mixture had an apparent density of 4.4 grams per cubic centimeter and a flow of 19 s/50 g (Arnold meter). Multiple lots were tested for apparent density and flow. The results of this testing are as follows:

| Lot | Apparent density (g/cc) | Flow (s/50 g) |
|---|---|---|
| 1 | 4.49 | 18.5 |
| 2 | 4.48 | 19 |
| 3 | 4.46 | 19.5 |

Next, the mixture of tungsten and iron was pressed in a high-speed rotary tablet press (Stokes BB2, 33-station) using modified spherical tooling with a nominal die size of 0.187 inches. The pressed projectiles had a nominal density of 9 grams per cubic centimeter, which was obtained by dividing the geometric volume in cubic centimeters by the weight in grams. In order to reduce individual measurement variations, groups of ten were collected and measured. In addition, these volumetric measurements were compared to certified density measurements made by the Archimedes technique at a certified, accredited testing laboratory. Results were nearly identical to the volumetric-based measurements.

| Sample | Density (g/cc) |
|---|---|
| 1 | 9.2 |
| 2 | 9.1 |
| 3 | 8.9 |

| Sample | Density (g/cc) |
|---|---|
| 1 | 9.18 |
| 2 | 9.03 |
| 3 | 8.92 |

The pressed projectiles were loaded into perforated steel baskets (10×10×2 inches) at 10 pounds per basket and fed into a 12-inch belt furnace with 2-inch gaps between the baskets. The belt furnace used had a protective 90:10 nitrogen-hydrogen atmosphere flowing at a total of 500 SCFH. Further, the furnace had two zones that were set for 1500° F. (pre-heat) and 2050° F. (high-heat), and the belt speed was set for six inches per minute.

The resulting sintered properties were measured at an independent accredited certified testing laboratory. In particular, the density was determined using the Archimedes technique (ASTM B 328), and the hardness was determined on the Rockwell HRB scale. The results of these tests are as follows:

| Density (g/cc) |
|---|
| 9.15 (Average - 10 pcs)<br>88.5% of theoretic mixture |

| Sample | Hardness (HRB) |
|---|---|
| 1 | 33 |
| 2 | 32.1 |
| 3 | 22.1 |

Example 2

In this example, the projectile 10 was prepared by blending 48% Titan 24 micron tungsten powder (TW24), 51.7% A-1000-B iron powder (as supplied by ARC Metals), and 0.3% Acrawax. Ten pounds of this mixture was blended by hand in a closed plastic container by shaking and rolling the container for ten minutes.

Next, the mixture was pressed in a high-speed rotary table press (Stokes BB1, 33-station) using modified spherical tooling with a nominal die size of 0.187 inches. Pressed projectiles had a nominal density of 9.3 grams per cubic centimeter. This nominal density was determined as discussed above. In order to reduce individual measurement variations, groups of ten were collected and measured.

The compacted projectiles were loaded into a perforated steel basket and fed into a 12-inch belt furnace, as discussed above. In this example, the furnace had two zones that were set for 1500° F. (pre-heat) and 2150° F. (high-heat), and the belt speed was set for six inches per minute.

The final density was determined using the Archimedes technique (ASTM B 328), and the hardness of the projectile was determined on a Rockwell HRB scale. Again, these properties were measured at an independent accredited certified testing laboratory. The results of these tests are as follows:

| Density (g/cc) |
|---|
| 9.39<br>9.3<br>9.14 |

| Sample | Hardness (HRB) |
|---|---|
| 1 | 29.4 |
| 2 | 36.3 |
| 3 | 37.5 |

Example 3

In this example, the projectile was prepared by blending 52% Titan 24 micron tungsten powder (TW24), 47.7% A-1000-B iron powder (as supplied by ARC Metals), and 0.3% Acrawax. Ten pounds of this mixture was blended by hand in a closed plastic container by shaking and rolling the container for ten minutes.

The mixture was compacted in a high-speed rotary tablet press as discussed above in connection with the previous examples. The pressed projectiles had a nominal density of 9.8 grams per cubic centimeter, as determined as discussed above. In order to reduce individual measurement variations, groups of ten were collected and measured.

Next, the pressed projectiles were loaded into a perforated steel basket and fed into a 12-inch belt furnace. The belt furnace used had a protective 90:10 nitrogen-hydrogen atmosphere flowing at a total of 500 SCFH. The furnace had two zones that were set for 1500° F. (pre-heat) and 2125° F. (high-heat), and the belt speed was set for six inches per minute.

The density and hardness were measured by an accredited, certified testing laboratory, as discussed above, using the Archimedes technique and a hardness scale of Rockwell HRB. The results of these tests are as follows:

| Density (g/cc) |
|---|
| 9.64<br>9.68<br>10.31 |

| Sample | Hardness (HRB) |
|---|---|
| 1 | 15.4 |
| 2 | 14.6 |

The present invention provides a projectile 10 and method of manufacturing this projectile 10, which results in a projectile 10 that has beneficial non-fragmenting and high ductility properties. The sintered tungsten iron projectile 10 is softer than either of the constituent materials due to the retained porosity, which allows movement of the materials under load. Again, this porosity is illustrated in FIGS. 2 and 3. Further, this porosity allows deformation of the iron particles, which is essentially an open web-like structure with tungsten particles locked within it. The iron particles, which are bonded together after sintering, are soft enough to deform under moderate load, and the sintering temperature is high enough to promote sufficient iron-to-iron bonding, yet low enough to avoid significant shrinkage due to sinter-densification or the formation of brittle intermetallic compounds.

The tungsten particles are simply mechanically wedged between the iron particles in a pressure-formed mechanical impingement. The operating window for tungsten iron projectiles 10 according to the present invention is roughly defined by those conditions that allow the material to remain soft by retaining greater than approximately 5% porosity after sintering, while at the same time reaching the desired density level by the appropriate additional level of tungsten and pressed density. Further, the present invention uses mechanical pressing to reach the final density and sintering simply to enhance iron-to-iron bonding and promote ductility. This invention has been described with reference to the preferred embodiments.

Obvious modifications and alterations will occur to others upon reading and understanding the preceding detailed description. It is intended that the invention be construed as including all such modifications and alterations.

The invention claimed is:

1. A projectile, comprising:

a compacted and sintered mixture of:

a) a plurality of tungsten particles that are from about 8 microns to about 30 microns in size;

b) a plurality of iron particles that are from about 40 microns to about 200 microns in size; and c) a material additive comprising at least one of the following: a chemical compound, a polymeric compound, a binder, and a lubricant, or any combination thereof;

wherein at least a portion of the plurality of iron particles are bonded together;

wherein there are no intermetallic compounds or alloys of the tungsten particles and the iron particles formed due, in part, to the size of the tungsten particles and the size of the iron particles utilized;

wherein the final density of the projectile is from about 8.0 grams per cubic centimeter to about 12.2. grams per cubic centimeter and the final hardness of the projectile is from about 10 HB to about 50 HB;

wherein densification is achieved when the mixture is compacted due to mechanical bond formation between the plurality of tungsten particles and the plurality of iron particles and there is no substantial densification occurring as a result of sintering; and wherein the ratio of the mixture of tungsten particles to iron particles is, by weight, from about 30:70 to about 65:35.

2. The projectile of claim 1, wherein the tungsten particles are in the form of a tungsten powder.

3. The projectile of claim 1, wherein the iron particles are in the form of an iron powder.

4. The projectile of claim 1, wherein the iron particles are at least one of the following: water-atomized iron particles, sponge iron particles, and iron powder, or any combination thereof.

5. The projectile of claim 1, wherein the tungsten particles and iron particles are mechanically compacted in a die.

6. The projectile of claim 5, wherein the tungsten particles and the iron particles are pre-blended prior to compaction.

7. The projectile of claim 1, wherein the material additive is a lubricant, wherein the lubricant is added to a mixture of the tungsten particles and the iron particles, and wherein the lubricant comprises up to 1% by weight of the mixture.

8. The projectile of claim 1, wherein the material additive is at least one: of the following: ethylenebissterimide, lithium carbonate, a carbonate compound, a stearate compound, copper stearate, and zinc stearate, or any combination thereof.

9. The projectile of claim 1, wherein the mixture is sintered in a sintering furnace under controllable atmospheric conditions.

10. The projectile of claim 1, wherein the projectile is sintered in a solid state sintering process.

11. The projectile of claim 1, wherein the projectile is a shot pellet.

12. The projectile of claim 1, wherein the projectile is a bullet.

13. The projectile of claim 1, wherein the temperature of the sintering process is from about 1500° F. to about 2450° F.

14. The projectile of claim 1, wherein the final hardness of the formed and sintered projectile is less than the final hardness of steel shot.

15. A projectile, comprising:

a compacted and sintered mixture of a plurality of tungsten particles and a plurality of iron particles, wherein at least a portion of the plurality of iron particles are bonded together;

wherein there are no intermetallic compounds or alloys of the tungsten particles and the iron particles formed;

wherein the final density of the projectile is from about 8.0 grams per cubic centimeter to about 12.2 grams per cubic centimeter;

wherein there is no substantial densification occurring as a result of sintering; and wherein the ratio of the mixture of tungsten particles to iron particles is, by weight, from about 30:70 to about 65:35.

16. The projectile of claim 15, wherein the tungsten particles are in the form of a tungsten powder.

17. The projectile of claim 15, wherein the tungsten particles are from about 8 microns to about 30 microns in diameter.

18. The projectile of claim 15, wherein the iron particles are from about 40 microns to about 200 microns in size.

19. The projectile of claim 15, wherein the iron particles are in the form of an iron powder.

20. The projectile of claim 15, wherein the iron particles are at least one of water-atomized iron particles, sponge iron particles, and iron powder.

21. The projectile of claim 15, wherein the tungsten particles and iron particles are mechanically compacted in a die.

22. The projectile of claim 21, wherein the tungsten particles and the iron particles are pre-blended prior to compaction.

23. The projectile of claim 15, further comprising a material additive.

24. The projectile of claim 23, wherein the material additive is at least one of the following: a chemical compound, a polymeric compound, a binder, and a lubricant, or any combination thereof.

25. The projectile of claim 23, wherein the chemical additive is a lubricant, wherein the lubricant is added to a mixture of the tungsten particles and the iron particles, and wherein the lubricant comprises up to 1% by weight of the mixture.

26. The projectile of claim 23, wherein the material additive is at least one of the following: ethylenebissterimide, lithium carbonate, a carbonate compound, a stearate compound, copper stearate, and zinc stearate, or any combination thereof.

27. The projectile of claim 15, wherein the mixture is sintered in a sintering furnace under controllable atmospheric conditions.

28. The projectile of claim 15, wherein the projectile is sintered in a solid state sintering process.

29. The projectile of claim 15, wherein the final hardness of the faulted and sintered projectile is from about 10 HB to about 50 HB.

30. The projectile of claim 15, wherein the projectile is a shot pellet.

31. The projectile of claim 15, wherein the projectile is a bullet.

32. The projectile of claim 15, wherein the temperature of the sintering process is from about 1500° F. to about 2450° F.

33. The projectile of claim 15, wherein the final hardness of the formed and sintered projectile is less than the final hardness of steel shot.

* * * * *

UNITED STATES PATENT AND TRADEMARK OFFICE

CERTIFICATE OF CORRECTION

PATENT NO. : 7,950,330 B2
APPLICATION NO. : 12/708005
DATED : May 31, 2011
INVENTOR(S) : Timothy G. Smith It is certified that error appears in the above-identified patent and that said Letters Patent is hereby corrected as shown below:

Column 11, Line 48, Claim 1, “12.2.” should read --12.2 --

Column 12, Line 8, Claim 8, “one:” should read -- one --

Column 12, Line 8, Claim 8, “ethylenebissterimide,” should read -- ethylenebisstearamide, --

Column 12, Line 67, Claim 26, “ethylenebissterimide,” should read -- ethylenebisstearamide, --

Column 13, Line 10, Claim 29, “faulted” should read -- formed --

Signed and Sealed this
Eighteenth Day of October, 2011

David J. Kappos

David J. Kappos
*Director of the United States Patent and Trademark Office*